US007287286B2

(12) United States Patent
Lee

(10) Patent No.: US 7,287,286 B2
(45) Date of Patent: Oct. 30, 2007

(54) CLOSESTOOL WITH CLEAN WATER INJECTOR AND PHOTO CATALYTIC BACTERICIDAL LAMPS

(76) Inventor: Hsueh-Hui Lee, No. 45, Lane 10, Jungjeng E. St., Huatan Shiang, Changhua (TW)

( * ) Notice: Subject to any disclaimer, the term of this patent is extended or adjusted under 35 U.S.C. 154(b) by 404 days.

(21) Appl. No.: 10/969,884

(22) Filed: Oct. 22, 2004

(65) Prior Publication Data

US 2006/0085902 A1 Apr. 27, 2006

(51) Int. Cl.
*E03D 9/08* (2006.01)

(52) U.S. Cl. ..... 4/420.4; 4/447

(58) Field of Classification Search ..... 4/420.4, 4/443, 447, 448

See application file for complete search history.

(56) References Cited

U.S. PATENT DOCUMENTS 5,790,934 A * 8/1998 Say et al. ..... 422/186
6,754,912 B1 * 6/2004 Hayashi et al. ..... 4/420.2
6,973,679 B1 * 12/2005 Schad ..... 4/420.4
2006/0124442 A1 * 6/2006 Valpey et al. ..... 204/157.15

* cited by examiner

*Primary Examiner*—Robert M. Fetsuga
(74) *Attorney, Agent, or Firm*—Rosenberg, Klein & Lee

(57) ABSTRACT

The closestool disclosed herein has an upper lid hinged to one end of the closestool thereof, a power supply unit equipped on the closestool; a clean water injector equipped underneath the power supply unit comprising a first and second cleaning nozzles, and a control unit attached to the closestool to stretch nozzles for water injection. The kernel of the present invention lies in that one or more bactericidal lamps having a sterilization effect with its photocatalytic film is provided to radiate conterminated part of the user's body thereby serving a sterilization effect during cleansing with water injection.

4 Claims, 2 Drawing Sheets

CLOSESTOOL WITH CLEAN WATER INJECTOR AND PHOTO CATALYTIC BACTERICIDAL LAMPS

BACKGROUND OF THE INVENTION

1. Field of the Invention

The present invention relates to a closestool with nearby and remote controlled first and second nozzles and photocatalytic bactericidal lamps so as to inject water from the nozzles to clean and sterilize the user's anus and contaminated surroundings after completing excretion.

2. Description of the Prior Art

It is a common sense that using toilet papers to wipe up the contaminated part is still insufficient to attain the purpose of cleansing up to 100%. Medical doctors teach us the excreta is the most dangerous medium of infectious disease therefore using the nozzles to clean the user's anus instead of wiping with toilet papers is a much better sanitary treatment.

There is, for example, an injection nozzle equipped closestool published by Taiwan Pat. No. 576459 in which the closestool has a water injector clamped at the rear end of the closestool seat and is connected to a water control faucet with a pipe. The water injector is composed of a nozzle with an elbow pipe at its rear end and a bottom lid. The inner cavity of the nozzle has a downwardly directed port, and a plurality of tapped holes are formed along the bottom edge thereof which can be combined with the corresponding screws provided with the bottom lid. A downwardly tapered pipe in the inner cavity passes through the central portion of the upper end surface of the nozzle, and the port is provided with a central straightly directed aperture and several slantly arranged apertures aimed to the pint at the center axis of the nozzle with a prescribed distance apart from the port of the nozzle. However, the water injector disclosed by this cited invention only has cleansing effect but, by no means, has s sterilizing effect since the clean water itself can not kill bacteria or other harmful microorganisms, or parasites etc.

For these defects noticeable on the prior art, an improvement is seriously required.

The inventor has dedicated great efforts for years to studying and improving these defects and come up with this invention to eliminate defects mentioned above.

SUMMARY OF THE INVENTION

The main object of the present invention is to provide a closestool with clean water injector and bactericidal lamps, the clean water injector further includes a first and a second cleasing nozzles respectively at their front ends for cleaning and sterilizing the contaminated part of the user's body with clean water injected from the nozzles and UV ray radiated from the bactericidal lamps so as to avoid spreading infectious diseases, the structure of DNA or RNA of the bacteria or virus is destroyed to lose its reconstruction ability thereby sterilizing the user's body and cleaning the closestool can be performed simultaneously.

Another object of the present invention is to provide a nearby and a remote controlled nozzles which serve for the user to select at random for use so as to assure perfect performance of sterilization.

To achieve the aforesaid objects, the closestool of the present invention is formed into an elliptical shape with an upper lid configurated into a shape corresponding to that of the closestool to be covered on the closestool and is hinged to the closestool at one end so that it can be lifted up to open the closestool for use or put down to cover the closestool when not in use. A power supply unit is equipped at the hinged end of the closestool and its upper lid. A clean water injector equipped underneath the power supply unit comprises a first and a second cleansing nozzles. A control unit is attached to outer side of the closestool to stretch one of the two nozzles for water injection when being actuated by the user after finishing use of the closestool. The front ends of the two nozzles are respectively provided with one or more bactericidal lamp to radiate the user's body so as to achieve cleansing and sterilization at the same time.

BRIEF DESCRIPTION OF THE DRAWINGS

The drawings disclose an illustrative embodiment of the present invention which serves to exemplify the various advantages and objects hereof and are as follows.

DETAILED DESCRIPTION OF THE PREFERRED EMBODIMENT

Figure 1:
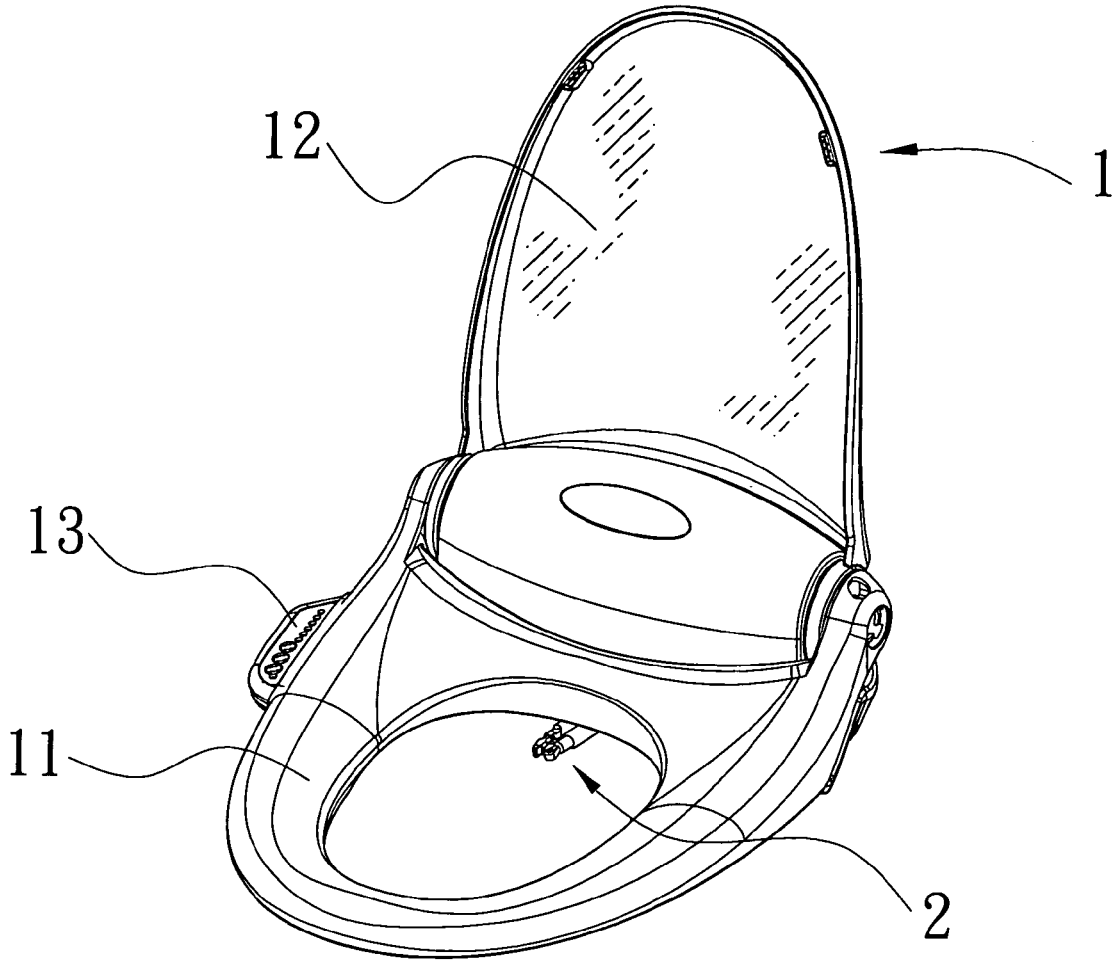
FIG. 1 is a three dimensional view of the closestool according to the present invention.
Figure 2:
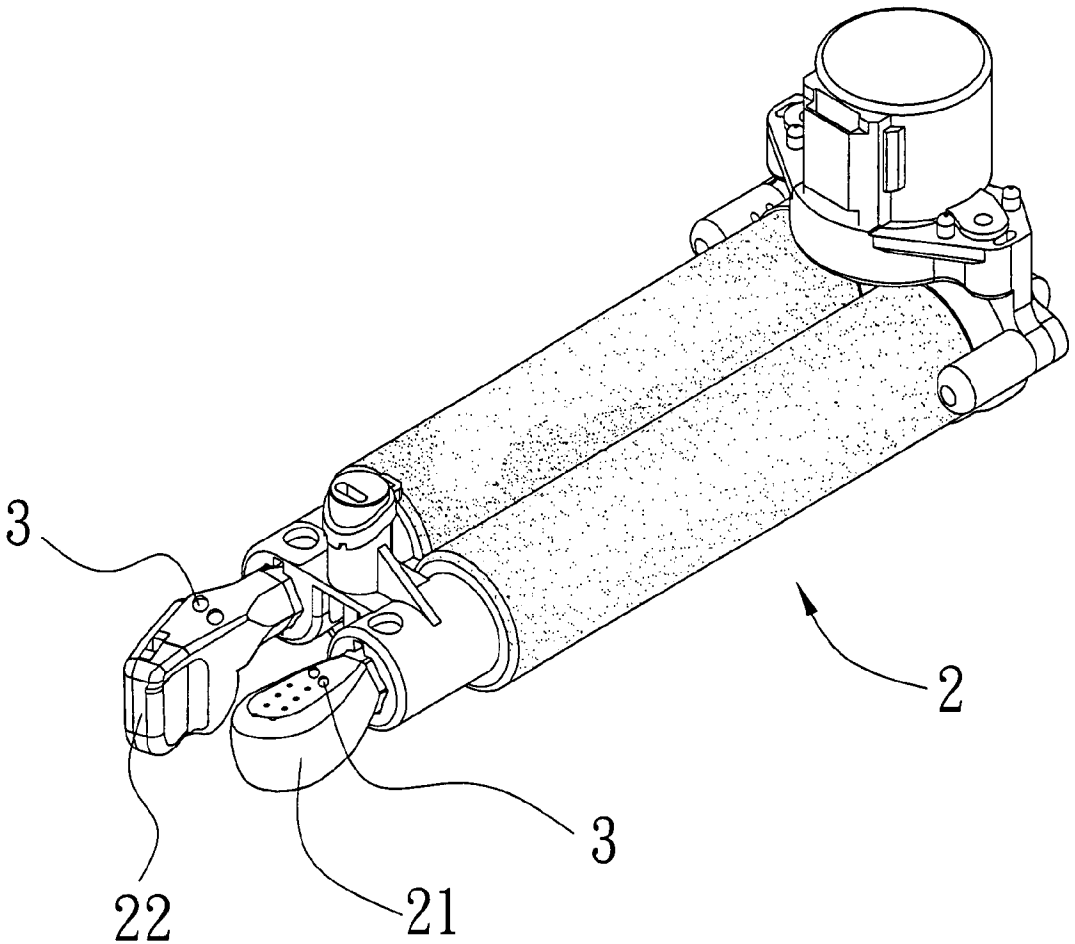
FIG. 2 is an assembly view of the clean water injector associated with its nozzles for the closestool according to the present invention.

Referring to FIG. 1 and FIG. 2, the present invention comprises an elliptical closestool 11 and an upper lid 12 configurated into a shape corresponding to that of the closestool 11 to be covered thereon is hinged to the closestool 11 at one end so that it can be lifted up to open the closestool 11 for use or put down to cover the closestool 11 when not in use. A power supply unit (not shown) is equipped at the hinged end of the closestool and its upper lid 12. A clean water injector 2 equipped undernearth the power supply unit includes a first and a second cleasing nozzles 21 and 22, and the clean water injector 2 is fed electric power from the power supply unit.

A nearby control unit 13 and a remote control unit (not shown) are attached to one side of the closestool 11 to stretch one of the two nozzles 21 and 22 for water injection when being actuated by the user after finishing use of the closestool 11. the front ends of both nozzles 21 and 22 are respectively provided with one or more bactericidal lamp 3 to radiate the injected water with its emitted light so as to sterilize the contaminated part of the user's body (please see FIG. 2). This specially equipped light source may be formed of LED.

The luminaire of this bactericidal lamp 3 is made of fiber glass coated with a layer of photocatalytic film. Or the photocatalytic film is directly coated on LED. The invisual ultra violet ray emitted from the bactericidal lamp 3 is absorbed by the photocatalytic film to convert water and oxygen contained in the air into ozone, and the ozone in turn to oxidate the bacteria and microorganisms in the air with its strong oxidation force to convert them into harmless carbon dioxide (CO2) and water (H2O), therefore the bactericidal lamp 3 is able to destroy the cellular membrane of a germ and oxidate the virulent protein so as to achieve sterilization effect and choke the spread of infectious disease.

No matter whether the first or the second nozzle 21 or 22 is chosen by the user through actuating either the nearby control unit 13 or the remote control unit, the clean water injected from either nozzle 21 or 22 is no more the clean water only, it can thoroughly sterilized the contaminated part of the user's body, with the aid of the light radiated from the bactericidal lamp 3.

Incidentally, UV ray emitted from the bactericidal lamp 3 has a much longer wave length compared to the ordinary UV wave length (254 nm) so that it is specially pertinent to persons who are allergic to light with its high factor or safety assuring no danger at all.

In all, the closestool with clean water injector and photocatalytic bactericidal lamp is able to perform two-fold mission of cleansing and sterilizing simultaneously thereby the user can enjoy comfortable and healthful effects.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A closestool with clean water injector and photocatalytic bactericidal lamps comprising a closestool with an upper lid hinged to one end of said closestool thereof so as to open or cover said closestool; a clean water injector comprising a first and a second cleansing nozzle; and a control unit being attached to outer side of said closestool to stretch said nozzles for water injection, wherein the front ends of said first and said second nozzles are respectively provided with one or more bactericidal lamp having a sterilization effect and capable of choking the infectious germs activity with is photocatalytic film.

2. The closestool of claim 1, wherein said bactericidal lamps are coated with a layer of photocatalytic film.

3. The closestool of claim 1, wherein said bactericidal lamps are enclosed in a fiber glass luminaire coated with a layer of photocatalytic film.

4. The closestool of claim 1, wherein said bactericidal lamp is formed of LEDS.

* * * * *